United States Patent [19]

Watanabe

[11] 4,352,493

[45] * Oct. 5, 1982

[54] PORTABLE OBSTACLE TOY

[75] Inventor: Hiroyuki Watanabe, Tokyo, Japan

[73] Assignee: Tomy Kogyo Co., Inc., Tokyo, Japan

[ * ] Notice: The portion of the term of this patent subsequent to Nov. 4, 1997, has been disclaimed.

[21] Appl. No.: 202,887

[22] Filed: Nov. 3, 1980

Related U.S. Application Data

[63] Continuation of Ser. No. 971,464, Dec. 21, 1978, Pat. No. 4,231,571.

[30] Foreign Application Priority Data

Dec. 28, 1977 [JP] Japan ..... 52-157850

[51] Int. Cl.[3] ..... A63F 9/14

[52] U.S. Cl. ..... 273/1 GA

[58] Field of Search ..... 273/1 GA, 1 GB; 434/63

[56] References Cited

U.S. PATENT DOCUMENTS

| | | | |
|---|---|---|---|
| 3,151,865 | 10/1964 | Faure et al. | 273/1 GA |
| 3,159,400 | 12/1964 | Brass et al. | 273/1 GA |
| 3,171,215 | 3/1965 | Glass et al. | 273/1 GA X |
| 3,575,413 | 4/1971 | Furukawa et al. | 273/1 GA |
| 4,231,571 | 11/1980 | Watanabe | 273/1 GA |

FOREIGN PATENT DOCUMENTS

| | | | |
|---|---|---|---|
| 943567 | 10/1948 | France | 273/1 GA |
| 364204 | 10/1962 | Switzerland | 273/1 GA |

*Primary Examiner*—Paul E. Shapiro

*Attorney, Agent, or Firm*—K. H. Boswell; Edward D. O'Brian

[57] ABSTRACT

An electrical mechanical toy has a housing including a base. A small electrical drive motor is mounted on the base and a drive diverter-transmission operatively connects to the drive motor. Also attached to the base is an endless belt mounting member having at least one endless belt mounted thereon such that the endless belt is capable of continuously traveling or orbiting about the mounting member. The drive diverter-transmission is connected to the endless belt such that the endless belt is driven by the drive motor about the mounting member. The endless belt includes at least one obstacle on its surface. An object member is slidably mounted on the base and includes an object attached to the object member and positioned proximal to the surface of the endless belt allowing the object to slide transversely to the direction of travel of the endless belt between an interference position with the obstacle on the surface of the endless belt and a non-interference position wherein the object does not interfere with the obstacle. The toy includes a detector which detects when the object is in the interference position with the obstacle and which disconnects the drive diverter-transmission from driving the endless belt when the obstacle is in the interference position. If the drive diverter-transmission is so disconnected a manual reset is actuated to restart movement of the endless belt.

4 Claims, 18 Drawing Figures

40
48
50
44
68
70
288
34
112
268
86
310
82
308
80
314
84
64
52
65
62
22
8
9
30
46
312
28
72
66
56
60
58
316
340
88
404
328
326
344
94
318
338
7
74
92
38
346
96
342
348
400
78
352
76
376
90
42
354
374
362
366
360
350
364
102
100

428
146
144
156
448
134
4
120
120
430
446
132
150
142
136
164
184
22
148
154
124
196
432
86
4
192
6
152
126
198
218
288
112
268
200
290
80
284
266
264
220
226
228
286
258
260
256
120
82
84
278
236
224
280
234
276
272
244
240
46
104
274
214
270
216
242
114
212
208
290
252
248
116
296
246
108
118
250
106
110
294
222
74
88
6
298
336
218
42
376
102

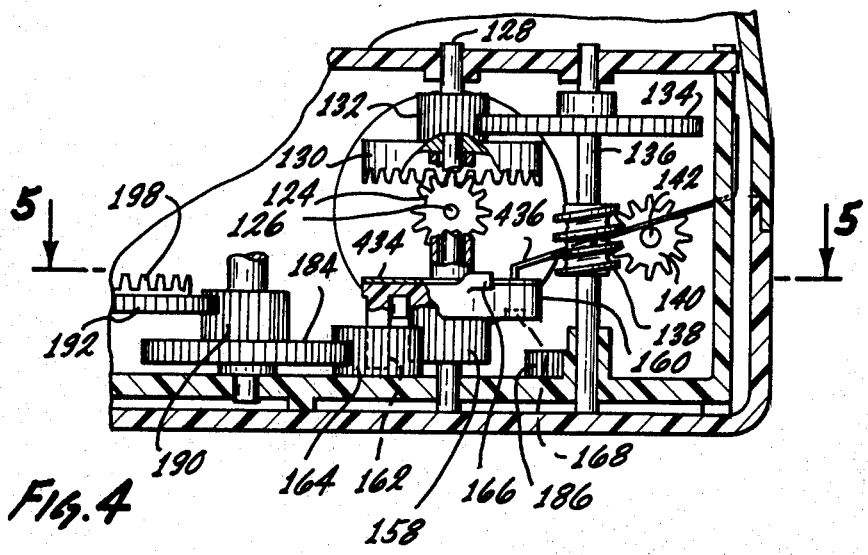
Fig. 4
Fig. 5
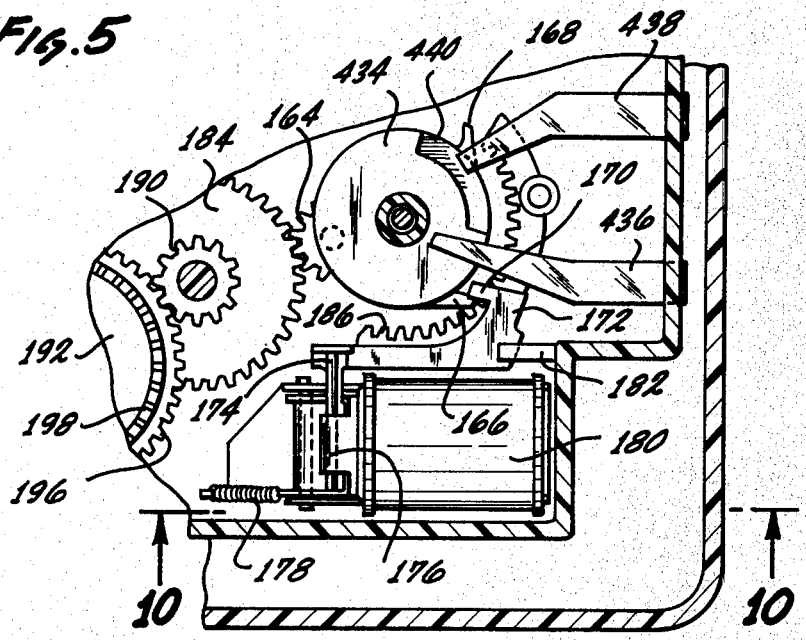

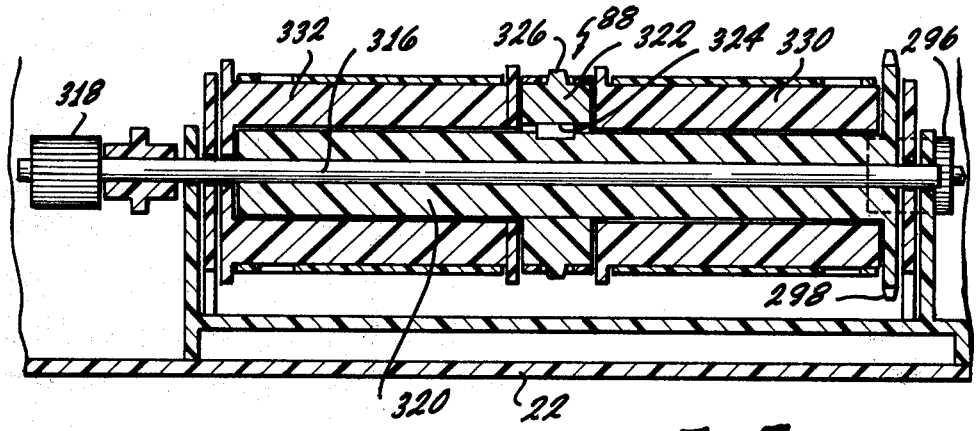
FIG. 7
FIG. 8
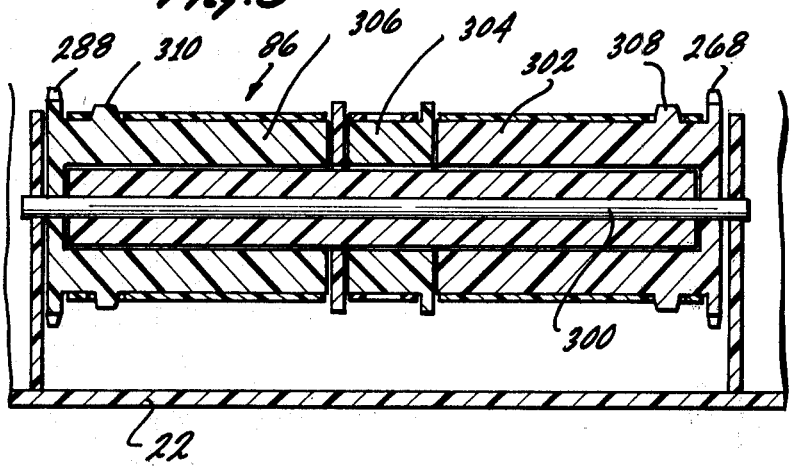

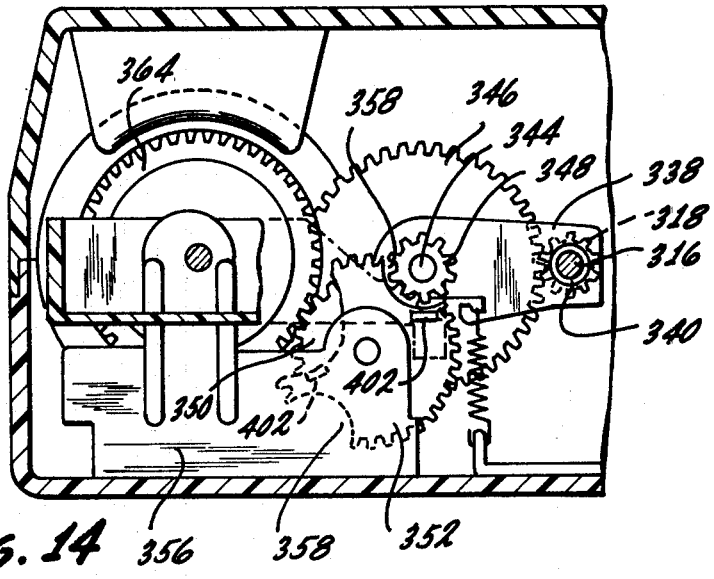
FIG. 14
FIG. 15
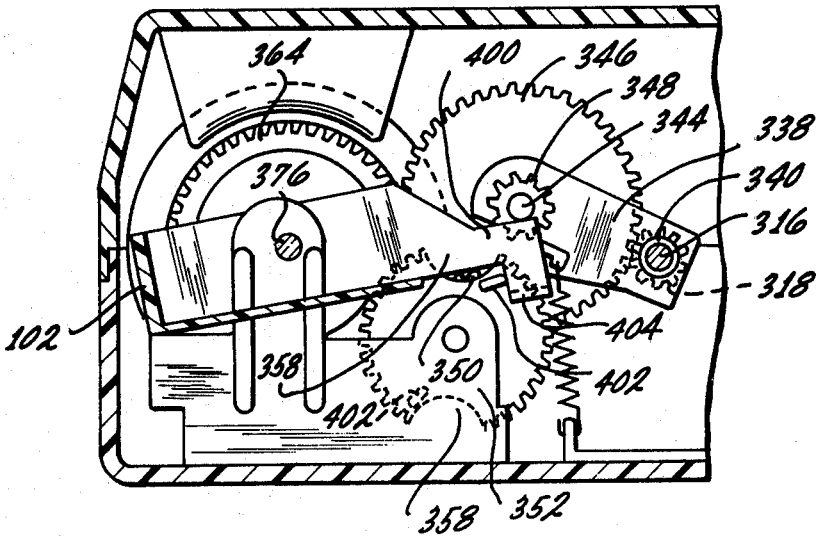

PORTABLE OBSTACLE TOY

This is a continuation of application Ser. No. 971,464, now U.S. Pat. No. 4,231,571 filed Dec. 21, 1978.

BACKGROUND OF THE INVENTION

This invention is directed to a portable electrical mechanical toy wherein the operator of the toy guides a small object, for example a race car, over a path created by a plurality of endless belts having collision obstacles on the surface of the endless belts. The path which the object must traverse is a continuously variable path because the number of and the location of the obstacles on the endless belts is such that, as the belts move, the position of any two collision obstacles in respect to one another is variable. Through a combination of the control of the speed of the belts and direction of rotation of the belts, the operator of the toy can steer or drive the object through a pathway that does not result in the collision of the object with any of the obstacles.

Presently there are two general types of mechanical apparatuses wherein an object is driven over or through a course which is painted or otherwise constructed on the surface of an endless belt. The first type of these apparatuses are used as training devices for teaching the handling and/or manipulation of an automobile or an airplane through or across a roadway or flight path which is formed on the surface of or projected from an endless belt or filmstrip mounted in the apparatus. The second class of these apparatuses is very similar to the first but is principally directed to "penny arcade" type amusement devices which require the operator of the apparatus to drive, fly or otherwise manipulate an object such as a race car or airplane through a pathway created by an endless belt or filmstrip and can include counting devices and/or penalty devices for accumulating and/or subtracting scoring points. Said scoring points reflecting the ability of the operator to successfully manipulate the object across the path and/or avoid obstacles.

Both of the two types of mechanical apparatuses, however, require large consoles and/or other supports and as such are expensive to produce and maintain and their use is limited to fixed training areas or amusement centers.

There is an additional class of games that has recently become available which utilize control modules in conjunction with television sets or other cathode ray tubes. While the modules of these games are portable, the total game itself is not in that it requires the use of the television or cathode ray tube to augment the module. Further because these devices incorporate sophisticated electronics they are also expensive.

For the devices which depend solely upon mechanically based tracks or paths as opposed to sophisticated electronically generated paths, the path is normally created by a endless belt, a disc or a repeating filmstrip. Because of the space limitation of storing an endless belt or filmstrip coupled with the direct manufacturing costs associated with each particular increment of length of said belt or filmstrip, the belt or filmstrip can only be of a limited length and as such can only contain a particular finite variation of pathway on the surface of the endless belt or filmstrip. The operator of such devices is thus able to quickly memorize the pattern of these endless belts or filmstrips and thus after only a few times of operating the device, the device no longer becomes challenging to the operator and interest in the device quickly subsides.

It is considered that games utilizing endless belts have a very definite recreation value, however, in view of the above inherent properties of the prior art devices including large physical size, easily memorized travel paths, and manufacturing expenses it is considered that there exists a need for small portable raceway toys which present a variable raceway or obstacle path which must be traversed. Further these toys must be economical to manufacture, durable during repeated use and capable of maintaining the interest of a large variety of age ranges of users.

BRIEF SUMMARY OF THE INVENTION

It is an object of this invention to provide a toy having a continuously variable raceway or obstacle course and an obstacle which traverses said course in response to commands by the operator of the toy. It is a further object of this invention to provide such a toy having the above characteristics but being small and portable and inexpensive to manufacture. Additionally it is an object to provide a toy which has a continuously variable raceway and thus maintains the interest of the user for extended periods of time.

These and other objects, as will be evident in the remainder of this specification, are achieved by providing an electrical mechanical toy having a base, a drive motor mounted on said base, a drive diverter means operatively connected to said drive motor, at least one endless belt, said endless belt having a substantially continuous surface, an endless belt mounting means attached to said base, said endless belt mounted on said endless belt mounting means such that said endless belt is capable of continuously traveling about said endless belt mounting means, said drive diverter means operatively connected to said endless belt driving said endless belt about said endless belt mounting means, at least one obstacle means on the surface of said endless belt, an object member slidably mounted on said base and including an object, said object positioned over the surface of said endless belt such that said object slides back and forth over the surface of said endless belt transversely to the direction of travel of said endless belt, said object having at least one interference position with said obstacle on said endless belt, a detecting means capable of detecting when said object is in said interference position, said detecting means connected to said drive diverter means such that said detecting means causes said drive diverter means to discontinue driving said endless belt when said object is in said interference position with said obstacle, reset means for reconnecting said drive diverter means to said endless belt and restarting said drive diverter means driving said endless belt about said endless belt mounting means.

The toy can further be provided with a signaling means which is operatively connected to the detecting means and emits a signal when said object and said obstacle are in said interference position. Further the toy can be provided with a counter means for evaluating the performance of the operator of the toy such as counting the amount of orbits or laps of the endless belt and this counter can be further coupled with a timing means which allows the toy to be operated for a unit length of time and allows the operator to test his skill by accumulating as many laps on the counter means as possible within the specific unit of time.

Normally the toy will include three endless belts, a left endless, a right endless and a center endless belt. Both the left and the right endless belts each having obstacle means thereon. Preferably each having a different number of obstacle means such that as the left and right endless belts move with respect to the object, the different number of obstacle means on the left and right endless belts present a continuously variable array of obstacles which must be traversed by the object. The left and right endless belts can move both forward and backward and each independently at different speeds, the center endless belt moves independently of both the left and right endless belts and connected to the lap counter for counting the progress of the object through the obstacles on the surface of the right and left endless belts.

BRIEF DESCRIPTION OF THE FIGURES

This invention will be best understood when taken in conjunction with the drawings wherein:

FIG. 4 is a side elevational view in partial section of a portion of the invention about the line 4—4 shown in FIG. 3.

FIG. 5 is a top view about the line 5—5 of the portion of the invention shown in FIG. 4.

FIG. 7 is a rear elevational view in partial section of a portion of the invention about the line 7—7 of FIG. 2.

FIG. 8 is a rear elevational view in section of a portion of the invention about the line 8—8 shown in FIG. 2.

FIG. 14 is a side elevational view in partial section of a portion of the invention taken about the line 14—14 of FIG. 2.

FIG. 15 is the same view as FIG. 14 except that certain components of the invention are shown in a different spacial relationship in respect to one another.

Figure 1:
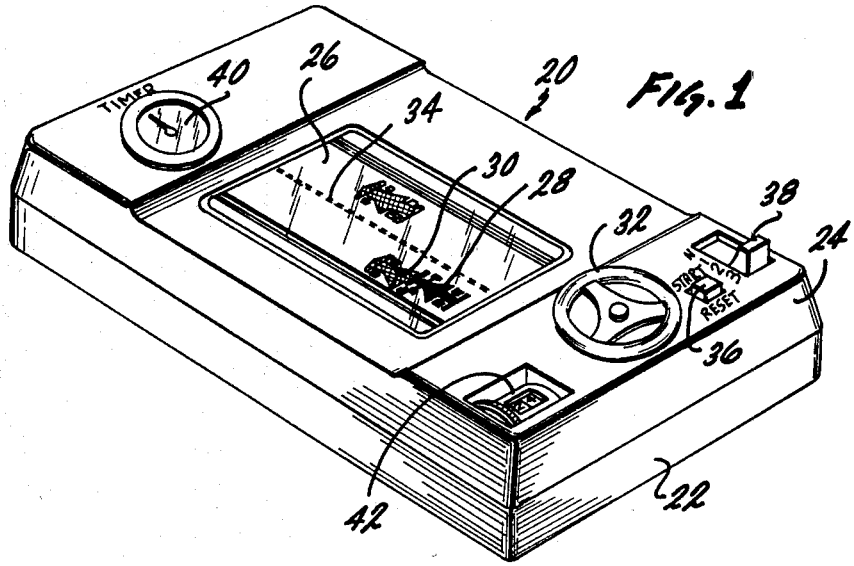
FIG. 1 shows an oblique view of the toy of the invention as it is used by an operator.

The electrical mechanical toy shown in this specification and in the drawings utilizes certain operative principles or concepts which are set forth and defined in the appended claims which form a part of this specification. Those skilled in the art to which this specification pertains will realize that these concepts and/or principles can be applied to a number of differently appearing and differently constructed embodiments. For this reason the invention is not to be construed as limited to the precise embodiment indicated but is to be construed in light of the claims.

DETAILED DESCRIPTION

In the figures there is shown a toy 20 having a base housing 22 and an upper housing 24 which are joined together forming a case for the toy. Centered in the upper housing 24 is a view window 26 through which can be seen an object 28 which is generally depicted as the top view of a formula style racing car. Also seen through the view window 26 are two obstacles collectively identified by the numeral 30 and which are also in the form of the top view of formula style racing cars. Both the object 28 and the obstacles 30 will be outlined in greater detail below. It is the object of the game to drive the object 28 on a path such that the object 28 does not crash into, i.e. assume an interference position with, the obstacles 30. In FIG. 1 it can be seen that object 28 has crashed into the rear end of the obstacle 30 on the left side.

A control or steering wheel 32 is connected to the object 28 as will be hereinafter described and is used to move the object 28 back and forth across the width of the viewing window 26 so that the object 28 can avoid the obstacles 30. The obstacles 30 are on the surface of endless belts (which will be numbered and described hereinafter) and which cause the obstacles 30 to travel in a path parallel to the dotted line 34 shown through viewing window 26. Dotted line 34 represents the painted dashed line which is commonly used to separate two lanes of a roadway.

The game is started by pushing down the start-reset button 36 which causes the obstacles 30 to move as hereinafter described. A transmission shifting lever 38 governs the speed and the direction of the obstacles 30 as hereinafter described. A timer 40 is operatively connected to the start-reset button 36 as hereinafter described and allows the toy to run for a preset time period once the start-reset button 36 is pushed. During this period of time the skill of the operator of the toy is measured by the number of laps which can be accumulated on the lap counter 42 as hereinafter described.

Figure 2:
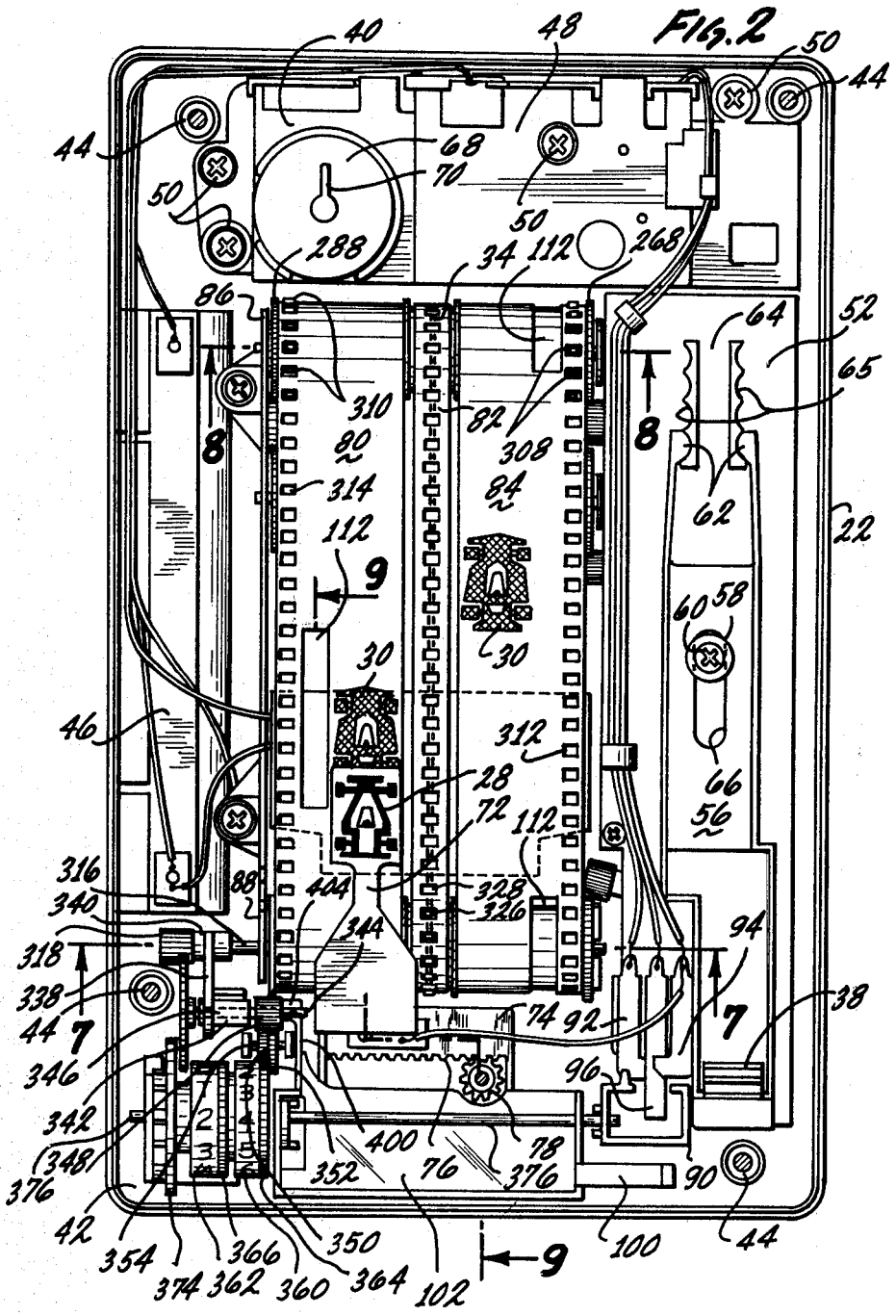
FIG. 2 is a top plan view of the toy shown in FIG. 1 with the top housing removed.
Figure 3:
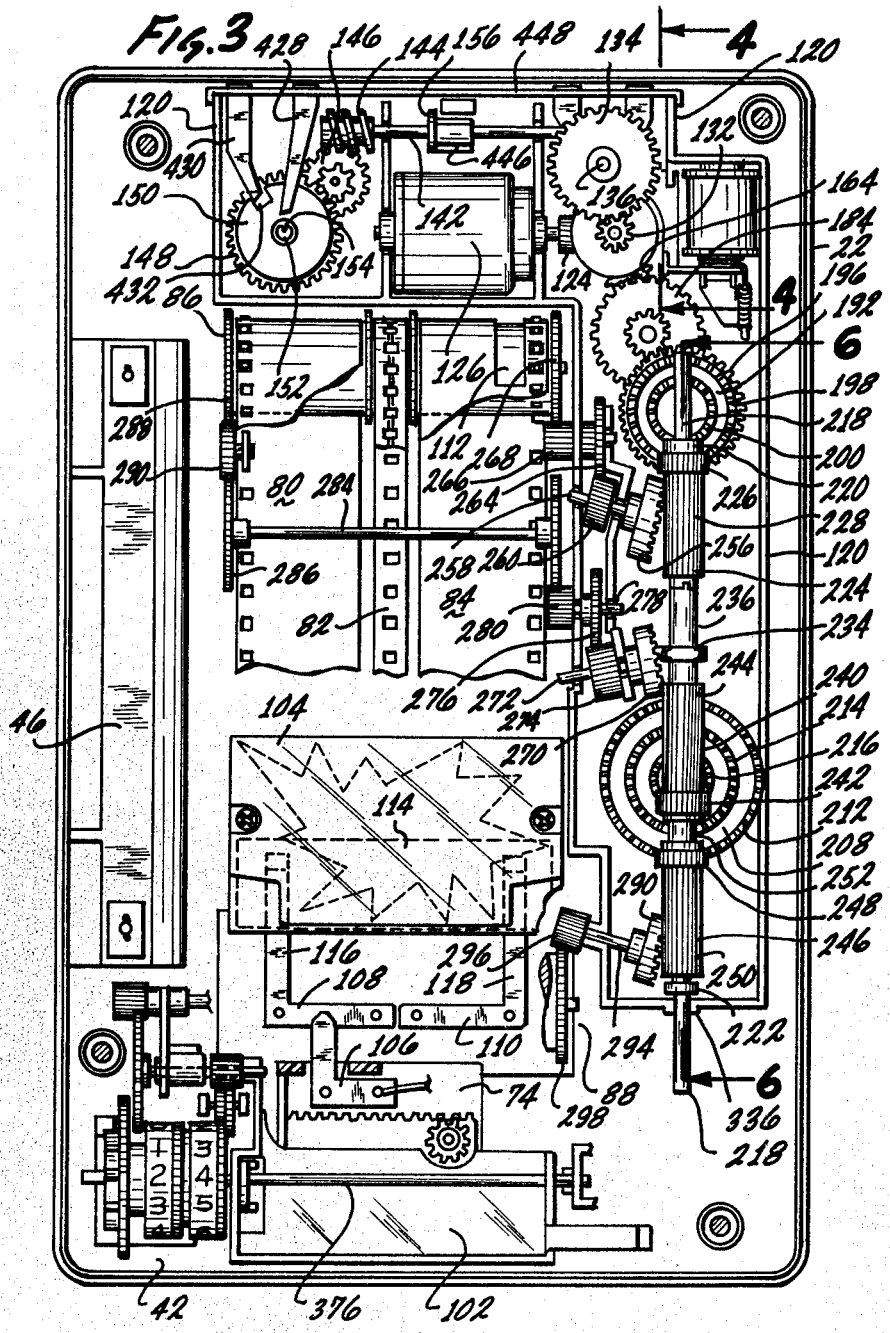
FIG. 3 is a top plan view in partial section similar to FIG. 2 except that certain of the components have been removed to show other components which lie beneath them.

Referring now to FIGS. 2 and 3, FIG. 2 generally depicts the internal mechanisms of the toy 20 as seen by removing the upper housing 24 from the base housing 22. These two housings are maintained together in the completed toy 20 by four screws (not shown) which pass through the underside of base housing 22 through four bosses collectively identified by the numeral 44 which are located near the four corners of the base housing 22. The screws screw into holes (not shown) in the upper housing 24 corresponding to the bosses 44 in the base housing 22. FIG. 3 shows the same view as FIG. 2 except certain overlaying components have been removed to show details of some of the underlying components. Within the base housing 22 is a battery pack 46 which is accessible from the underneath side of base housing 22 and which contains batteries (not shown) used to supply power to operate the toy.

A motor-timer cover plate 48 attaches to the base housing 22 by four screws collectively identified by the numeral 50. A transmission cover plate 52 attaches to the base housing 22 by a plurality of screws, collectively identified by the numeral 54, one of which is shown in FIG. 2. Mounted on the transmission cover plate 52 is a shifting member 56. Shifting member 56 is maintained on a boss 58 projecting from the surface of transmission cover plate 52 by a broad headed screw 60. The transmission-shifting lever 38 is integrally formed with and forms part of shifting member 56. On the opposite end of shifting member 56 are two opposed detent dogs collectively identified by the numeral 62. The detent dogs 62 fit into a rack 64 formed on the surface of transmission cover plate 52. The rack 64 has two opposed sets of four indents 65 each of said indents 65 defining a transmission position as is hereinafter described. Shifting member 56 has a cutout channel 66 which slides along boss 58 as the shifting member 56 is slid from one gear position to another.

The timer 40 includes a timer disc 68 having a timer hand 70 integrally formed on the surface thereof. The timer disc 68 and timer hand 70 are exposed through the surface of upper housing 24 when this housing is attached to base housing 22. This allows the operator of the game to read how much elapsed time has transpired since the operation of the game was started.

Object 28 is integrally formed with a clear plastic object supporting member 72 which in turn is attached to object supporting member base 74. This base includes a gear rack 76 which meshes with gear pinion 78. As hereinafter described, in response to rotation of steering wheel 32, gear pinion 78 engages gear rack 76 causing object supporting member base 74 to slide back and forth within base housing 22.

Three endless belts, left side belt 80, center belt 82 and right side belt 84 are mounted around a front belt spindle 86 and a rear belt spindle 88. Painted on the surface of both the right side belt 84 and the left side belt 80 are obstacles 30. All three belts 80, 82 and 84 continuously orbit around the front and rear belt spindles 86 and 88. Preferably one of the left or right side belts 80 or 84 will have two obstacles 30 painted on the surface thereof spaced on opposite points on the belt and the other of the left or right side belts 80 or 84 will have three obstacles 30 symmetrically spaced about its surface. Thus for each complete revolution on one of the belts, two obstacles will pass a particular point, such as the point directly beneath the object 28, and for each complete revolution of the other belt, three obstacles will pass this same point. This fact coupled with both the direction of rotation of the endless belts, i.e. the obstacles either move forward or backward, and the speed of the endless belts about the front and rear belt spindles 86 and 88, results in a variety of combinations of the obstacles on the left side belt 80 in respect to the obstacles on the right side belt 84, making it necessary for the operator of the toy to shift gears (as hereinafter described) in order to avoid interference of the object 28 with the obstacles 30.

The object 28 slides back and forth slightly above the surface of endless belts 80, 82 and 84. When viewed from the top, since the object support member 72 is clear plastic, the obstacles 30 can be seen beneath the object support member 72 allowing for visual overlap of the object 28 with the obstacles 30. When this visual overlap occurs, other components of the invention, as hereinafter described, are also caused to interact and a crash between the object 28 and the obstacle 30 occurs. In response to this crash, the motion of the belts cease and both a visual and an audio signal is given.

The center belt 82 has a dotted line 34 printed on its surface and when the center belt 82 is in motion this dotted line appears through view window 26 as a dividing line in a roadway. The lap counter 42 is connected to center belt 82, as hereinafter described, and each time the center belt 82 completes one full revolution or orbit around front and rear spindles 86 and 88, respectively, it is counted as one lap.

Figure 13:
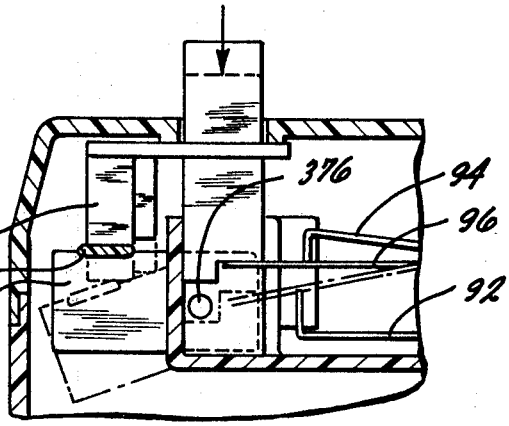
FIG. 13 is a side elevational view in partial section of a portion of the invention taken about the line 13—13 of FIG. 2.

The start-reset button 36 which was shown in FIG. 1 fits into reset button housing 90 in base housing 22. Three electrical contacts 92, 94 and 96, respectively, are positioned within the reset button housing 90 and as shown in FIG. 13 contact 96 normally fits against contact 94 allowing for completion of an electrical circuit through the two contacts. When start-reset button 36 is depressed, as shown in phantom in FIG. 13, the electrical circuit between 94 and 96 is broken and a new electrical circuit between contacts 96 and 92 is formed. Start-reset button 36 (see FIG. 13) has an extension 98 which projects in the direction away from the contacts 92, 94 and 96. Normally extension 98 rests upon arm 100 of penalty reset member 102. When the start-reset button 36 is depressed, extension 98 assumes the position shown in phantom in FIG. 13. Further details of the electrical circuit associated with the penalty reset member 102 are given hereinafter.

Figure 9:
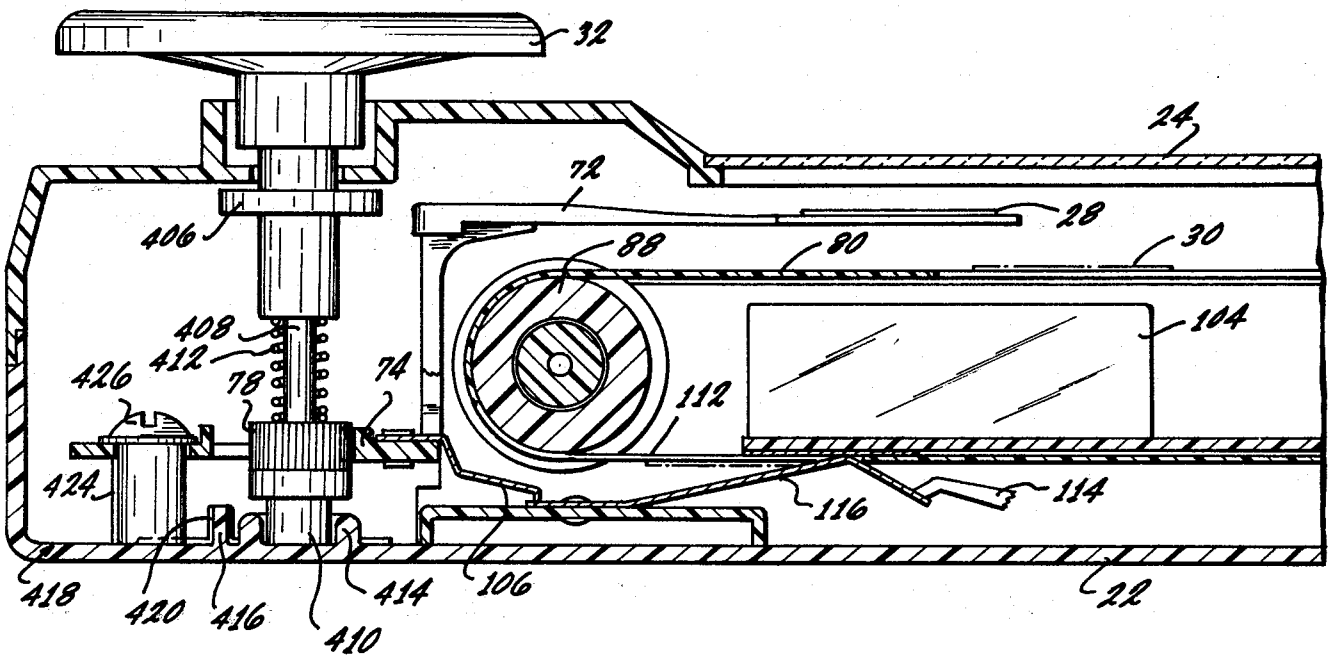
FIG. 9 is a side elevational view in partial section of a portion of the invention taken about the line 9—9 of FIG. 2.

Spaced in between front belt spindle 86 and rear belt spindle 88 and within the interior of the loop described by the endless belts 80, 82 and 84 is a flasher light housing 104 which is seen in top view in FIG. 3 and in side view in FIG. 9. This housing contains a light bulb (not shown) which lights up during a crash between the object 28 and an obstacle 30. Attached to object support member base 74 is electrical slide contact 106 which is wired to contact 94. Positioned underneath rear belt spindle 88 is left stationary contact 108 and right stationary contact 110. These contacts are placed such that slide contact 106 completes an electrical circuit through either left stationary contact 108 (as depicted in FIG. 3) or right stationary contact 110. The left stationary contact 108 and right stationary contact 110 are positioned in respect to one another such that slide contact 106 is at all times in contact with one or the other of the contacts 108 or 110.

Endless belts 80 and 84 both contain cutout portions, collectively identified by the numeral 112, extending through their surfaces. Referring to FIG. 9, it can be seen that when object 28 is overlaying an obstacle 30, a cutout portion 112 is positioned on the bottom side of the loop of left belt 80 proximal to rear spindle 88 and light housing 104. Positioned underneath light housing 104 between base housing 22 and the bottom of continuous belts 80 and 84 is a transverse electrical contact 114 which extends continuously across the width of all of the belts 80, 82 and 84. Integrally formed with left side stationary contact 108 is left spring contact 116. Integrally formed with right side stationary contact 110 is right spring contact 118. Referring to FIG. 9, it can be seen that the left spring contact 116 is biased in an upward direction and normally rests against the surface of left side belt 80. In a similar manner, right spring contact 118 rests against the surface of right side belt 84.

When any of the obstacles 30 are in a position such that if the object 28 were directly over one of them an interference position between the object 28 and that particular obstacle 30 is created. When this happens, the cutout portion 112 corresponding to the particular obstacle 30 is positioned such that either the left or right spring contact 116 or 118, depending whether the particular obstacle 30 is on the left or right side belt 80 or 84, passes upward into the cutout portion 112 in the respective belt. In so doing it contacts the transverse contact 114 theoretically completing an electrical circuit. This electrical circuit, however, can only be completed when the slide contact 106 is on the same respective, left or right side as is the particular obstacle 30 and as such is in contact with the left or right stationary contact 108 or 110 to which the respective spring contact 116 or 118 is connected to.

Motor timer cover plate 48 and transmission cover plate 52 are fixed by screws to motor and gear support housing 120 which fits within base housing 22. Housing 120 contains appropriate drillings and cutouts and together with other drillings and cutouts in motor timer cover plate 48 and transmission cover plate 52 a plurality of gear shafts and other components are supported within the housing 120. In the interest of brevity these drillings and cutouts will not be individually identified and numbered, it being deemed sufficient simply to state that the gear shafts and other components are appropriately supported or fixed in these housings and covers. A small electrical motor 122 is mounted in appropriate cutouts in housing 120 and contains a small pinion 124 on motor shaft 126.

The drive train for the timer 40 and the belts 80, 82 and 84 is shown in FIGS. 3, 4, 5 and 6. A shaft 128 is fitted with a crown gear 130 which has a pinion 132 integrally formed on its upper face. To transfer motion to the timer a spur gear 134 meshes with pinion 132 and transfers the motion of the motor 122 along shaft 136 to worm gear 138. A small spur gear 140 attached to shaft 142 meshes with worm gear 138 and transfers the motion along shaft 142 to worm gear 144 which in turn transfers the motion to gear 146 having both a spur and a pinion integrally formed thereon. Gear 146 then drives timer gear 148. Timer gear 148 has a metal contact disc 150 fixedly attached to its surface. The function of this disc will be described hereinafter. The shaft 152 to which timer gear 148 is fixedly attached contains a small slot 154. The bottom (not shown) of timer disc 68 contains a boss having a key which fits into slot 154 and maintains timer disc 68 in a fixed position with respect to shaft 152. A three lobed cam 156 is also attached to shaft 142 the function of which will described hereinafter.

Figure 10:
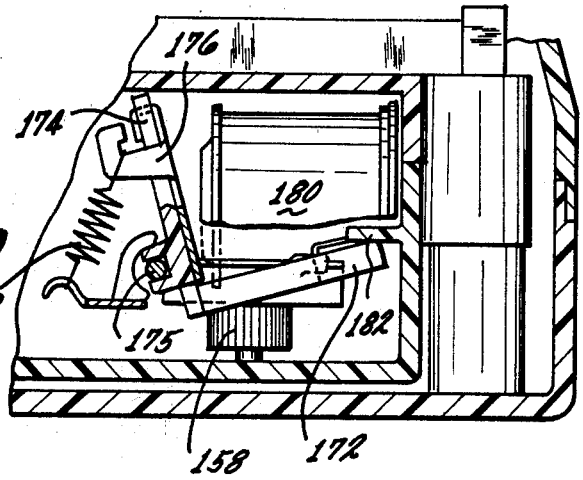
FIG. 10 is a side elevational view in partial section of that portion of the invention shown in FIG. 5.
Figure 11:
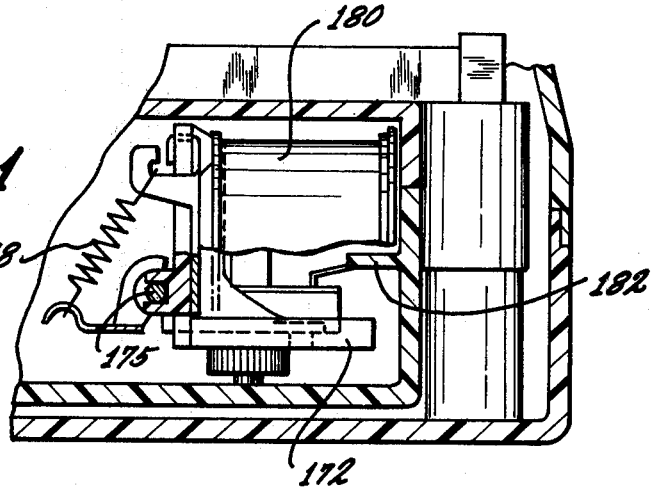
FIG. 11 is the same view as FIG. 10 with the exception that certain components of the invention are shown in a different spacial relationship to one another.

Referring back to the belt drive, second pinion 158 is fixed near the bottom of shaft 128. A circular disc 160 having an upstanding bearing extension integrally formed therewith (not separately numbered) fits around shaft 128 in between crown gear 130 and pinion 158. Disc 160 is not attached to shaft 128 but is free wheeling thereon. Projecting from the underside near the edge thereof of disc 160 is an axle 162. A pinion 164 slips over axle 162 and is free to spin about axle 162. Pinion 164 meshes with pinion 158. Two ratchet teeth, upper ratchet tooth 166 and lower ratchet tooth 168, extend tangentially from the circumference of disc 160. A pawl 170, attached to an arm 172 which in turn is attached to a hinge member 174, interacts with the upper and lower ratchet teeth 166 and 168. The hinge member 174 contains an iron plate 176 on its surface and is biased about hinge pin 175 by spring 178 away from a solenoid 180. A stop 182 (see FIG. 10) is so placed such that arm 172 rests against the bottom surface of stop 182 in response to movement of the hinge member 174 away from solenoid 180 in reaction to spring 178. In this position pawl 170 interacts with upper ratchet tooth 176 maintaining disc 160 in the position shown in FIG. 5 which places and holds axle 162 and pinion 164 against spur gear 184. In this position the rotary motion of motor 122 is transferred via pinions 158 and 164 to spur gear 184.

When solenoid 180 is energized, as hereinafter described, hinge member 174, by virtue of its having iron surface 176 attached to it which is magnetically attracted to energized solenoid 180, swings about hinge pin 175 causing arm 172 to move in a downward direction which releases pawl 170 from upper ratchet tooth 166. By virtue of the gearing described, shaft 128 is turning in a counterclockwise direction in response to rotation of motor shaft 126. The inertia of this counterclockwise spin causes disc 160 to momentarily also spin in a counterclockwise motion until pinion 164 comes in contact with gear rack 186 and engages with gear rack 186. Pinion 164 then is carried around rack 186 by the motion imparted to pinion 164 by pinion 158.

Figure 12:
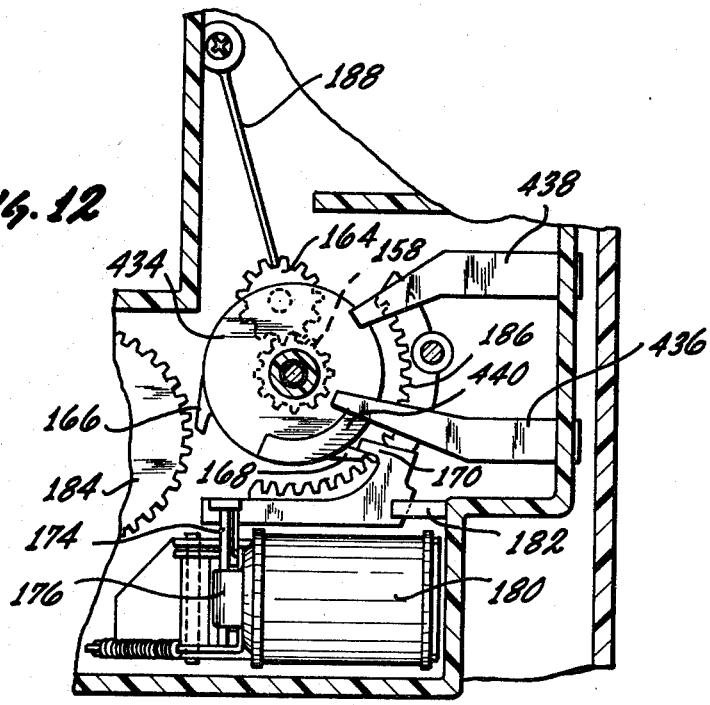
FIG. 12 is a top plan view of essentially the same area shown in FIG. 5 except that certain components are shown in a different spacial relationship in respect to one another.

Under the influence of solenoid 180 arm 172 is held in its downward position and as soon as pinion 164 has traveled the length of rack 186 in a counterclockwise direction inertia continues to carry disc 160 in this counterclockwise direction until bottom ratchet tooth 168 engages pawl 170 which stops disc 160 in the position shown in FIG. 12. During this sequence of events it is noted that the motion of motor 122 is not transferred to spur gear 184. When pinion 164 is in the position shown in FIG. 12 and maintained therein by interaction between ratchet tooth 168 and pawl 170, pinion 164 interacts with a noise emitting clicker extension 188. Thus as pinion 164 rotates against clicker 188 the teeth of pinion 168 strike against the end of clicker 188 causing clicker 188 to emit a high pitched whine. Further discussion of the function of clicker 188 will be presented hereinafter.

When disc 160 is in the position shown in FIG. 5, i.e. upper ratchet tooth 166 is retained by pawl 170, motion of motor 122 is transferred to spur gear 184. Integrally attached to spur gear 184 is pinion 190. Transfer of motion to the endless belts 80, 82 and 84 via pinion 190 will be described in reference to FIGS. 3 and 6. A compound gear 192, having one set of crown teeth 194 on the bottom thereof, a set of spur teeth 196 around the circumference thereof, an outside set of crown teeth 198 and an inside set of crown teeth 200 on the upper surface thereof, interacts with pinion 190 via spur gear teeth 196. A shaft 202 having pinions 204 and 206 fixed on the respective ends thereof is driven by the interaction of pinion 204 with bottom crown teeth 194. A second compound gear 208 has a set of crown teeth 210 on its bottom surface and three sets, an outer 212, a middle 214 and an inner 216 set of crown teeth, on its upper surface. Compound gear 208 is rotated by interaction of bottom crown teeth 208 with pinion 206. Thus the motion of pinion 190 is also transferred to compound gear 208.

A shaft 218 having identical thrust bearings 220 and 222 attached proximal to the ends thereof, is fitted with four gears which are slid onto shaft 218 and are free to rotate about this shaft. Because of the fixed position of thrust bearings 220 and 222 on shaft 218 and placement of this shaft in housing 120 as hereinafter described, shaft 218 can slide back and forth in housing 120 within the limits defined by the placement of thrust bearings 220 and 222. The first of the four gears on shaft 218 is gear 224. It has a set of pinion teeth 226 and a set of long pinion teeth 228. The pinion teeth 226 fit up against thrust bearing 220. On the long pinion end of gear 224 is a short extension 230 having two identical notches 232 on opposite sides thereof. The second of the four gears on shaft 218 is a pinion 234 having only four teeth. An extension 236 of this gear has two ears 238 on the opposite sides thereof which fit into notches 232 and communicate any motion of gear 224 to gear 234. The third gear 240 on shaft 218 is identical to gear 224 in that it has a set of pinion teeth 242 and a set of long pinion teeth 244, however, it is oriented on shaft 218 such that the long pinion teeth 244 are directed toward gear 234. The fourth gear 246 on shaft 218 also has a set of pinion teeth 248 and a set of long pinion teeth 250 and it is positioned on shaft 218 such that long pinion teeth 250 are proximal to thrust bearing 222. In between the pinion teeth 248 and 242 on gears 244 and 240, respectively, is a thrust bearing 252. A shifting fork 254 is integrally formed with and extends from shifting member 56 and transfers the motion of shifting member 56 to shaft 218. Because gears 224, 234, 240 and 246 are maintained on shaft 218 between thrust bearings 220 and 222, these gears in respect to housing 120 slide as shaft 218 slides in housing 120 and their position with respect to housing 120 corresponds to the position of shift member 56 with respect to cover plate 52 on housing 120.

As seen in FIG. 3 a crown gear 256 meshes with long pinion teeth 228 and transfers motion along shaft 258 to pinion 260. Pinion 260 engages with spur gear 262 which transfers motion along shaft 264 to pinion 266. Pinion 266 engages with spur gear 268 which drives right side endless belt 84 as hereinafter described. Crown gear 270 engages with long pinion teeth 244. Additionally depending upon the position of shaft 218 and consequently the position of gear 234 crown gear 270 also engages with gear 234, however, even when engaged with gear 234 it still maintains its engagement with long pinion teeth 244. Motion of crown gear 270 is transferred by shaft 272 to pinion gear 274 which in turn transfers motion to spur gear 276 attached to shaft 278. Pinion gear 280 also attached to shaft 278 transfers motion to spur gear 282 which is attached to shaft 284. Shaft 284 is placed inside of the endless belts 80, 82 and 84 and conveys the rotary motion of spur gear 282 to spur gear 286. Spur gear 286 drives spur gear 288 via intermediate pinion 290. The motion of spur gear 288 is transferred to the left side belt 80 as hereinafter described. Crown gear 290 meshes with long pinion teeth 250 and transfers motion via shaft 294 to pinion 296. Pinion 296 meshes with spur gear 298 which transfers motion to center belt 82 as hereinafter described.

Front belt spindle 86 is appropriately mounted in base housing 22 by a central shaft 300 as seen in FIG. 8. Front belt spindle 86 is made up of three components the exact details of which are not necessary to the understanding of this specification and thus are not herein described in the interest of brevity, it being sufficient to note that there is a right side belt front spool 302, a center belt front spool 304 and a left side belt front spool 306 which all are capable of independently rotating about shaft 300. Integrally formed with right side belt front spool 302 is spur gear 268. Integrally formed with left side belt front spool 306 is spur gear 288. Integrally formed on right front spool 302 are right side belt drive teeth 308. Integrally formed on left side belt front spool 306 are left side belt drive teeth 310. Right and left side drive teeth 308 and 310 respectively mesh with appropriate holes collectively numbered as 312 and 314 on the right and left side belts 84 and 80 respectively as shown in FIG. 2 and transfer the motion from spur gears 268 and 288 to the right and left side belts 84 and 80 respectively.

As seen in FIG. 7 rear spindle 88 is appropriately mounted in base housing 22 by a central shaft 316. Fixed to and causing rotation thereof of rear shaft 316 is spur gear 298. On the other end of shaft 316 is a pinion gear 318 which rotates in respect to rotation of spur gear 298. Spur gear 298 is attached to a central housing 320 which is also fixed to shaft 316 and rotates in respect to shaft 316. A center rear spool 322 is keyed via key 324 to central housing 320 and thus also rotates in respect to spur gear 298. A plurality of center belt drive teeth 326 are integrally formed with rear center spool 322. These teeth 326 mesh with holes 328 as seen in FIG. 2 and drive center belt 82 in respect to rotation of spur gear 298. Right rear spool 330 and left rear spool 332 are both mounted about central housing 320 such that they are freewheeling and independent of the motion of the central housing 320. This allows right side belt 84 and left side belt 80 to freely turn about rear belt spindle 88 in response to their movement about the front belt spindle 86 previously described.

Referring back to FIG. 1, printed on upper housing 24 next to the transmission shifting lever 38 are the numerals N, 1, 2 and 3. These numerals are meant to represent the corresponding analogous gears found in a race car. In practice of the invention, the speed and the direction of the belts 80, 82 and 84 are governed by the interaction of appropriate gears. The three belts 80, 82 and 84 move in respect to one another differently, depending on what gear, i.e. position, the shifting lever is in. As was previously noted, transmission shifting lever 38 is connected to shift member 56 and on the underside of shift member 56 is shifting fork 254 which fits over thrust bearing 252. Motion of transmission shift lever 38 is therefore directly transferred to shaft 218 by interaction of shift fork 254 with thrust bearing 252.

For the purpose of describing the interaction of drive gears of the toy 20, the section of any gear closest to journal 334 will be described as the front side section of the gear and the portion of the gear closest to journal 336 will be described as the backside section of the gear. When any of the belts 80, 82 or 84 moves such that its direction when viewed through view window 26 is from the steering wheel 32 of toy 20 toward the timer 40 end of toy 20, the belt is deemed to be moving in a forward direction and when the belt moves in the opposite direction it is deemed to be moving backward.

When shifting lever 38 is in the position corresponding to the letter N (neutral) printed on the upper housing 24, shaft 218 is positioned relative to journals 334 and 336 such that thrust bearing 220 is immediately adjacent to journal 334. Pinion 226 interacts on the front side (i.e. the side toward pinion 190) of crown gear teeth 200 of compound gear 192. In response to this the right side belt 84 moves forward. Pinion teeth 242 of gear 240 mesh with middle upper crown teeth 214 of compound gear 208 which in turn drive the left side belt 80 forward. Pinion teeth 248 of gear 246 are positioned directly over the center of compound gear 208 and thus do not interact with any of the gear teeth on compound gear 208. As such center belt 82 remains stationary.

When transmission shifting lever 38 is moved into the position opposite the numeral 1 (first gear) shaft 218 is shifted a first increment back from journal 334, positioning pinion teeth 226 of gear 224 in the center of compound gear 192. As such gear 224 does not move and the right side belt 84 remains stationary. In this position pinion teeth 242 of gear 240 interact on the forward side of innercrown gear teeth 216 of compound gear 208 which causes the left side belt 80 to move forward, however, at a speed slower than it moves relative to the speed of the moving when the transmission shift lever 38 was in neutral. Pinion teeth 248 of gear 246 mesh with the backside of inner crown teeth 216 of compound gear 208 resulting in center belt 82 moving backward.

When the transmission shifting lever 238 is moved to the 2 (second gear) position shaft 218 is shifted a second increment back from journal 234 and pinion teeth 226 of gear 224 now mesh with the backside of inner upper crown teeth 200 of compound gear 192 resulting in right side belt 84 moving in a backward direction. Pinion teeth 248 of gear 240 are now placed in the center of compound gear 208 and as such are not rotated by compound gear 208. However, in this position pinion 234 meshes with crown gear 270 and as such because pinion 234 is rotated by gear 224 via gears 238 and notches 232, crown gear 270 is also rotated by gear 224 meshing with compound gear 192. This results in the left side belt 80 moving in a backward direction. Pinion teeth 248 of gear 246 mesh on the backside of middle upper crown teeth 214 of compound gear 208. This causes the center belt 82 to move backward, however, since the middle crown teeth 214 are of a larger diameter than inner crown teeth 216 on compound gear 208 the speed of the center belt, when transmission shifting lever is in second gear, is faster than when it is in first gear.

When transmission shifting lever 38 is moved such that it corresponds to the numeral 3 (third gear) shaft 218 is moved the final increment back and thrust bearing 222 is now flush against journal 336. In this position pinion teeth 226 of gear 224 mesh with outer upper crown teeth 198 on the backside of compound gear 192. This results in right side belt 84 maintaining its rearward direction but increasing its speed compared to the second gear position. Pinion 234 is moved so it no longer meshes with crown gear 270 and as such does not influence the speed of left side belt 80. The speed of left side belt 80 is now controlled by pinion teeth 242 of gear 240 meshing with inner crown teeth 216 on the backside of compound gear 208. As a result left side belt 80 continues moving backward, however, its speed is faster than it was when it was in second gear. Pinion teeth 248 of gear 246 now mesh with outer crown teeth 212 on the backside of compound gear 208 resulting in center belt 82 maintaining its backward direction, however, its speed is greater than it was in second gear.

Referring to the lap counter 42 in the lower left hand portion of FIG. 2 and in part to FIG. 7 a gear support member 338 has a bearing section 340 which is freely mounted on shaft 316 and thus does not move in respect to rotation of shaft 316. A second bearing section 342 supports an axle 344 having a spur gear 346 on one end thereof and a pinion 348 proximal to the other end. Spur gear 346 meshes with pinion 318 which is fixed to shaft 316 as before noted. Thus spur gear 346 is rotated in respect to movement of shaft 316 which in turn corresponds to movement of center belt 82. This movement is transferred via axle 244 to pinion 348. The movement of center belt 82 is thus transferred to the lap counter 42 by pinion 348.

Spur gears 350 and 352 are appropriately mounted on an axle 354 which is in turn mounted on lap counter housing 356. Lap counter housing 356 is attached to base housing 22 by a screw (not numbered). Spur gear 352 is slightly larger than spur gear 350 and contains two cutout portions collectively identified by the numeral 358 which are slightly larger than pinion 348. As can be seen in FIG. 14 this allows pinion 348 to fit into one or the other of the cutout portions 358 in spur gear 352 and mesh with spur gear 350. Normally pinion 348 will rest within one of the cutouts 358 and contact spur gear 350.

Figure 16:
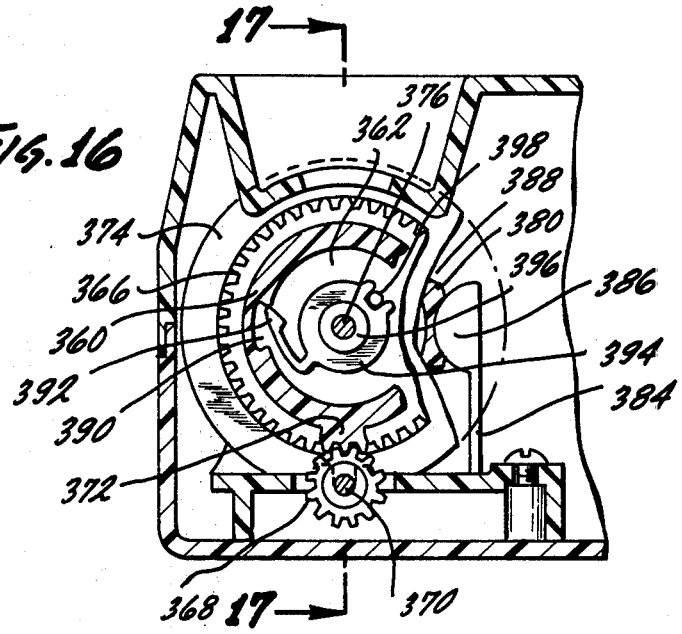
FIG. 16 is a side elevational view in partial section of a portion of the invention taken about the line 16—16 of FIG. 3.
Figure 17:
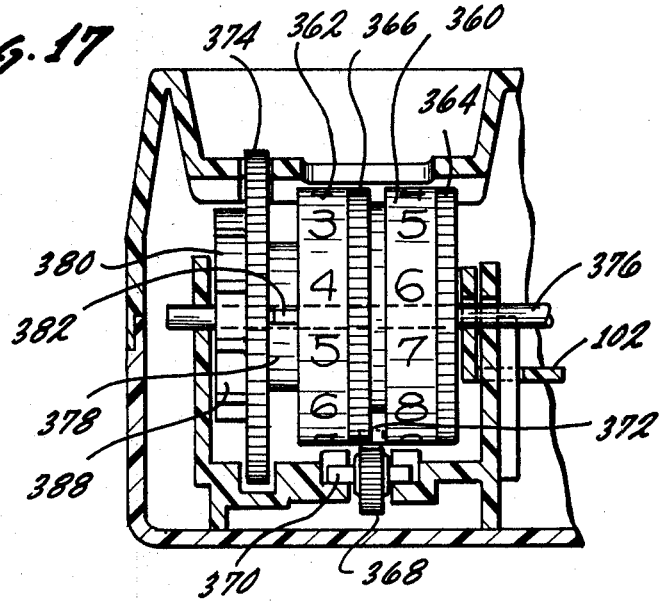
FIG. 17 is a rear elevational view in partial section about the line 17—17 of FIG. 16.

The lap counter 42 contains a unit wheel 360 and a tens wheel 362. Each of these wheels are numbered around their circumference from zero to nine allowing for counting of from zero to ninety-nine laps. On the right side of unit wheel 360 are spur gear teeth 364, similarly on the right side of tens gear wheel 362 are spur gear teeth 366. Spur gear 350 meshes with spur gear teeth 364 on unit wheel 360 as seen in FIG. 2. Motion from unit wheel 360 is transferred to tens wheel 362 by the interaction of spur gear 368 which is mounted on axle 370 which in turn is mounted in the bottom-most portion of lap counter housing 356. In FIG. 17 on the left side of unit wheel 360 is a short rack of gear teeth 372. Spur gear 368 is always in contact with spur gear teeth 366 on tens wheel 362. When unit wheel 360 turns normally there is no interaction with unit wheel 360 and spur gear 368; however, when rack 372 approaches spur gear 368 it contacts spur gear 368 and meshes with it for one tenth of a revolution of unit wheel 360. This can be seen in FIG. 16. When rack 372 meshes with spur gear 368 the rotary motion of unit wheel 360 is transferred to tens wheel 362 and causes tens wheel 362 to advance one tenth of a revolution. This causes the lap counter to successfully count one through nine on the unit wheel and then advances the tens wheel one digit to count from ten to nineteen before advancing the tens wheel a second digit to count from twenty to twenty-nine and so on.

Unit wheel 360 and tens wheel 362 along with knurled knob 374 are mounted on axle 376 within lap counter housing 356. Axle 376 further extends from lap counter housing 356 to reset button housing 90 and supports penalty reset member 102. Knurled knob 374 has a slotted boss 378 extending toward tens wheel 362 and an indented boss 380 on the other side. Tens wheel 362 contains a key 382 which fits into slotted boss 378 and fixedly attaches knurled knob 374 with respect to rotation of tens wheel 362. A flexible arm 384 extends from lap counter housing 356 and has a detent ear 386 on its end. Detent ear 386 meshes with indent boss 380 as seen in FIG. 16 by fitting into any one of ten detents 388 symmetrically spaced about indent boss 380. As the tens wheel 362 is rotated the detent ear 386 tends to retain tens wheel 382 in any one of these positions which serves to center the particular numeral on the tens wheel which is visible on the lap counter 42 showing through upper housing 24.

In order to reset both the unit wheel 360 and the tens wheel 362 back to zero at the conclusion of using the toy, as seen in FIG. 16 the interior of the unit wheel 360 acts as a ratchet in that it has one ratchet tooth opening 390. This ratchet tooth opening 390 interacts with pawl 392 which is attached to pawl holding member 394 which fits around bearing 396 of tens wheel 362. Normally during counting the units wheel 360, as shown in FIG. 16, would spin in a clockwise direction and pawl 392 would not interact with the ratchet tooth opening 390. When resetting the lap counter 42 to zero the tens wheel 362 is turned clockwise via knurled knob 374 which projects through upper housing 24 and pawl 392 catches in ratchet tooth opening 390 causing the motion of the tens wheel to be transmitted to the units wheel. The ratchet tooth opening 390 and a pin 398 are positioned such that the pawl 392 slips into ratchet tooth opening 390 when the numeral zero on the tens wheel lines up with the numeral zero on the units wheel.

After a crash, as hereinafter described, reset button 36 must be depressed in order to restart any or all of the belts 80, 82 and 84 which are stopped because of the crash. As seen in FIG. 13 extension 98 on reset button 36 meshes with arm 100 on penalty reset member 102. Penalty reset member 102 swivels about axle 376. On the end of penalty reset member 102 near lap counter 42 is an extension 400. This extension can be seen in FIGS. 2 and 15 and as shown in FIG. 15 the extension fits under and is capable of lifting axle 344. This in turn swivels gear support member 358 about bearing section 340 on shaft 316. The result is pinion 348 is lifted clear of spur gear 350. This position is shown in FIG. 15. When in this position lap counter 42 is no longer connected to center belt 82 and ceases to accumulate laps in respect to movement of center belt 82.

Positioned on spur gear 352 adjacent to cutout portions 358 are two ratchet teeth collectively identified by the numeral 402. As seen in FIG. 15 the ratchet teeth 402 are positioned on the backward side of cutout portions 358 when spur gear 352 is rotating counterclockwise. On the bottom part of extension 400 is a ratchet tooth 404 which projects toward spur gear wheel 352. When reset button 36 is depressed along with lifting axle 344 the ratchet tooth 404 on extension 400 interacts with one of the ratchet teeth 402 urging this ratchet tooth upward causing spur gear 352 to rotate through several degrees in a counterclockwise direction. This causes cutout portion 358 to no longer be positioned directly in line with pinion 348 and when the reset button 36 is released extension 400 moves in a downward direction which lowers gear support member 358. A spring not shown in the figure but which attaches to the bottom of gear support member 338 and to base 22 is responsible for biasing member 338 toward base 22.

Because spur gear 352 is of a larger diameter than spur gear 350 and because cutout portions 358 are no longer in position to receive pinion 348, pinion 348 meshes with spur gear 352. Rotation of pinion 354 in respect to movement of center belt 82 is now transferred to spur gear 352 instead of spur gear 350. As a result lap counter 42 is not rotated as long as pinion 348 is not allowed to mesh with spur gear 350. Spur gear 352 turns about axle 354 for approximately 180 degrees at which time the other cutout portion 358 approaches pinion 348 and when this other cutout portion 348 is directly underneath pinion 348 pinion 348 descends through the other cutout portion 358 until it once again contacts spur gear 350 and restarts drive of lap counter 42. The net result is that whenever reset button 36 is depressed lap counter 42 is disengaged from center belt 82 for the increment of time necessary to rotate spur gear 352 through approximately 180 degrees. Since the object of the game is to accumulate as many laps as possible, the operator of the toy is penalized each time the operator pushes the start/reset button 36.

As noted previously, object 28 is moved sideways across the surface of belts 80, 82 and 84 in response to movement of steering wheel 32. As shown in FIG. 9 steering wheel 32 projects above upper housing 24. Immediately below upper housing 24 is a circular member 406 which is attached to a steering column 408. Steering wheel 32 is retained against circular member 406 by a screw (not shown) through the center of steering wheel 32. Since circular member 406 is attached to column 408, column 408 rotates in response to rotation of circular member 406. At the bottom of column 408 is a second circular member 410 which is also fixed to column 408 and rotates in response to rotation of column 408. Pinion 78 is mounted on column 408 but is free to rotate independently of column 408. In between pinion 78 and circular member 406 is a spring 412. Spring 412 is under slight compression which causes pinion 78 to frictionally fit against second circular member 410. As a result pinion 78 will normally rotate in response to rotation of second circular member 410, thus object 28 can be moved in response to steering wheel 42. If pinion 78 is at either end of rack 76, such as that shown in FIG. 2 wherein pinion 78 is at the extreme right side of rack 76, pinion 78 will no longer be free to rotate in one or the other of either a clockwise or a counterclockwise direction (in FIG. 2 pinion can no longer be rotated counterclockwise, however it can be rotated clockwise). In such a case continued movement of steering wheel 32 in the restricted direction is no longer transferred to pinion 78. By virtue of spring 412 there is a built-in frictional clutch between pinion 78 and circular member 410.

Base housing 22 contains an upstanding boss 414 which serves as a bearing for second circular member 410. Base housing 22 additionally has a rib 416 traversing across its bottom surface 418 which serves as a guide for groove 420 in object supporting member base 74. Object supporting member base 74 includes a second groove 422 which fits over upstanding boss 424 integrally formed with base 22. Object supporting member base 74 is retained on base housing 22 by a broadheaded screw 426 which screws into upstanding boss 424.

It was previously noted that timer gear 148 has a metal contact disc 150 attached to its surface. Two electrical contacts 428 and 430 respectively extend over the metal contact disc 150. One of these contacts, contact 428 is longer than the other contact 430. In the surface of metal contact disc 150 is a small cutout portion 432 which exposes a portion of the nonconducting surface of timer gear 148. As timer gear 148 turns this cutout portion 432 also turns. Contact 428 meets with and makes electrical contact with contact disc 150 near the center of contact disc 150 such that contact 428 is always in electrical contact with metal disc 150 and is not in any way effected by cutout portion 432. The shorter contact 430, however, makes contact with metal contact disc 150 near the outer edge thereof. When the timer is positioned as shown in FIG. 3, however, electrical contact between contact 430 and disc 150 is broken because cutout portion 432 now lies directly underneath the contact point of contact 430 with disc 150. This in effect breaks an electrical circuit as hereinafter described between contact 428, metal contact disc 150 and contact 430.

The position represented in FIG. 3 is the off position of the toy. When the start-reset button 35 is depressed motor 122 is energized and as previously described motion of motor 122 is transferred to timing gear 148.

This causes timing gear 148 and metal contact disc 150 attached to its surface, to rotate. After rotating a few degrees the cutout portion 432 on metal contact disc 150 is no longer directly beneath contact 430 and contact 430 now contacts the surface of metal contact disc 150. This completes an electrical circuit which includes motor 122 and continues driving motor 122 independent of start-reset button 36. Motor 122 continues to rotate via this circuit until the cutout portion 432 in metal contact disc 150 has made a complete circle and again becomes positioned underneath contact 430. When this happens the circuit driving motor 122 is broken and motor 122 ceases to rotate. The time period for the cutout portion 432 to complete a full rotation is the time period allotted to the operator of the toy to accumulate as many laps as possible.

A second electrical switch similar to the timing switch just described is incorporated on the surface of disc 160. This second switch is illustrated in FIGS. 4, 5 and 12 and it serves as a bypass or alternate connection to maintain current through the "crash" electrical circuit as hereinafter described. A metal electrical contact disc 434 is attached to the surface of disc 160. Two electrical contact arms 436 and 438 extend over the surface of contact disc 434. Contact disc 434 contains a cutout portion 440 extending through a portion of the outside surface of contact disc 434 equal to approximately 90 degrees which exposes a portion of the non-conducting surface of disc 160. The two contact arms 436 and 438 are of unequal length such that contact arm 436 extends toward the center of contact disc 434 beyond the cutout portion 440 and make continuous electrical contact with contact disc 434. Contact arm 438, however, is shorter than contact arm 436 and meets contact disc 434 near its outer edge where cutout portion 440 is located. This results in contact arm 438 alternately completing a circuit between contact arm 436, contact 434 and contact arm 438 as shown in FIG. 12 and breaking this same circuit as shown in FIG. 5.

When the toy is in operation and pinion 164 is in contact with spur gear 184 transferring the rotary motion of motor 122 to the various belts 80, 82 and 84 as previously described, the circuit between contact disc 434 and contact arms 436 and 438 is open. That is it is broken by cutout portion 440. If solenoid 180 is activated resulting in arm 172 releasing upper ratchet tooth 66, disc 160 rotates as previously described. This results in cutout portion 440 of contact disc 434 also rotating allowing contact arm 438 to complete electrical contact through contact disc 434.

A lamp 442 (shown only as an electrical symbol on FIG. 18) is located in light housing 104. Additionally incorporated in the electrical lamp circuit, as hereinafter described, is a flasher switch 444 which alternately opens and closes the electrical circuit. The mechanical components of flasher switch 444 are shown in FIG. 3. An electrical contact 446 is positioned such that it fits against the surface of cam 156. As cam 156 rotates about shaft 152, as previously described, electrical contact 446 alternately makes and breaks electrical contact with a second contact (not shown in the figures) which is positioned adjacent to electrical contact 446 on support housing 448 which is mounted between base housing 22 and motor-timer cover plate 48.

Figures 6, 18:
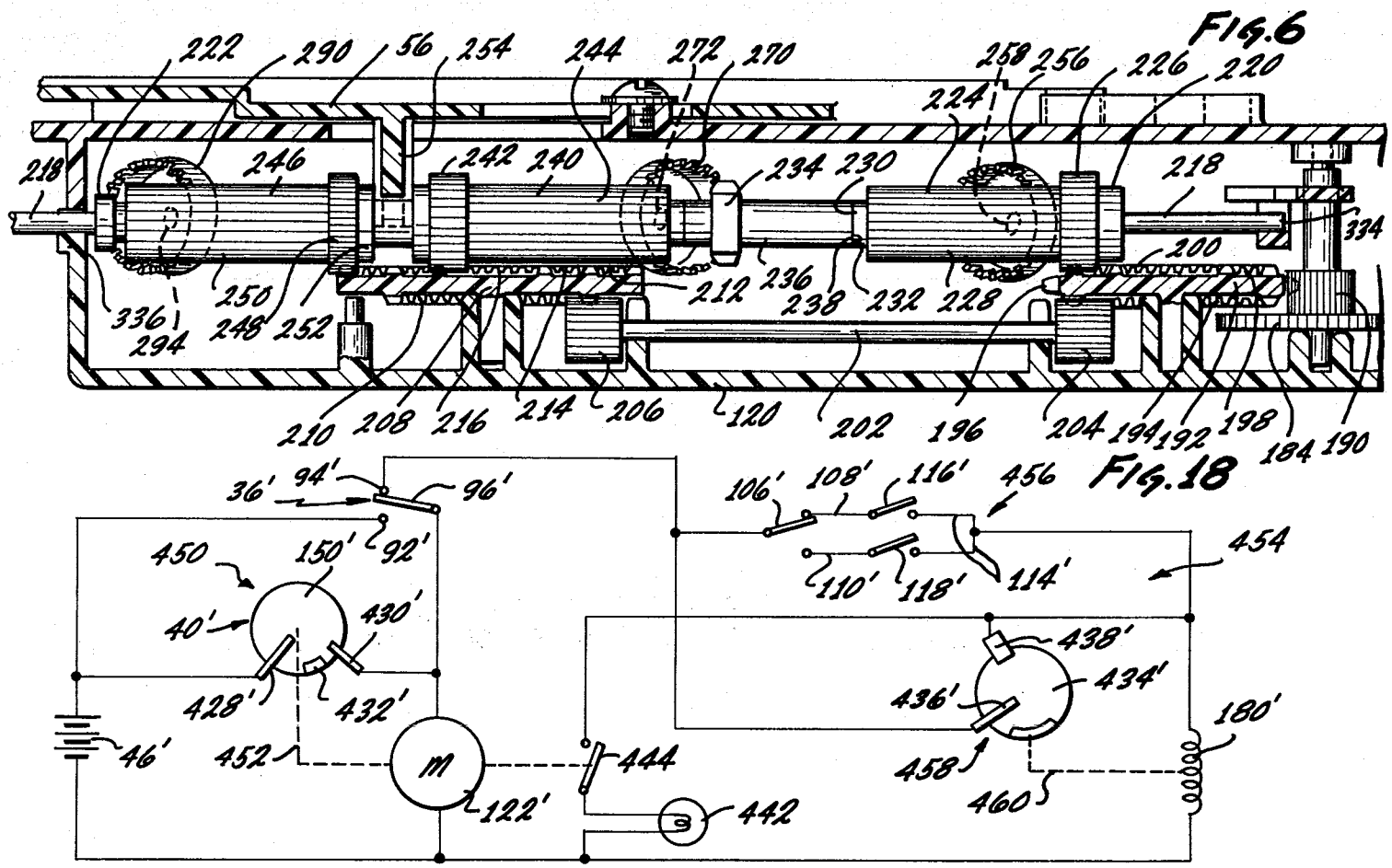
FIG. 6 is a side elevational view in partial section of a portion of the invention about the line 6—6 of FIG. 3.
FIG. 18 is a circuit diagram for the electrical components of the invention including a diagramatic representation of several of the components of the invention.

The electrical circuit utilized in the toy 20 is shown in FIG. 18. In describing this circuit in relationship to the mechanical components previously described, in order to facilitate understanding of the circuit and operation of the toy, wherever appropriate the components used in the circuit will be identified by the numerals used to describe their mechanical equivalents followed by a ′ (prime). Further the circuit diagram shown in FIG. 18 will generally be followed in a clockwise direction around the individual electrical circuits which together form the composite electrical circuit of the toy 20.

A first circuit or normal operation mode circuit 450 contains the start-reset button 36′ wired in parallel with timer 40′ and together these two components 36′ and 40′ are wired in series with a motor 122′ and a battery pack 46′. to activate the toy start-reset button 36′ is depressed connecting contact 96′ with contact 92′ which completes the circuit to motor 122′. The mechanical linkage between the motor 122′ and the timer 40′, as hereinafore described, is depicted by dotted line 452. This activates timer 40′ and when disc 150′ has rotated such that contact 430′ is free of cutout portion 432′ and completes the circuit between contact 428′, disc 150′ and contact 430′, the circuit to the motor 122′ is now completed through timer 40′ and start-reset button 36′ can then be released.

The endless belts are then caused to rotate by motor 122 as previously described and the operator of the toy by using a combination of changing the position of the object 28 alternately back and forth over the left and right side belts by turning steering wheel 32 and by changing the speed and direction of the belts through the use of the transmission lever 38 tries to avoid overlap of the object 28 with any of the obstacles 30.

A second circuit or crash circuit 454 contains the object obstacle interference sensor detecting switches 456 wired in parallel with the bypass or diverter switch 458. These two are then wired in series with the start-reset button 36′, solenoid 180′ and the battery pack 46′. Circuit 454 also contains light 442 wired in series with flasher switch 444 and together lamp 442 and switch 444 are wired in parallel with solenoid 180′.

The object obstacle interference detection switch 456 consists of contacts 106′, 108′, 110′, 116′ and 118′. The bypass of diverter switch 458 consists of disc 434′ and contacts 436′ and 438′. This switch 458 is mechanically and magnetically connected or linked as depicted by dotted line 460 to solenoid 180. The dotted line 460 thus represents upper and lower ratchet teeth 166, 168, arm 172, pawl 170 and metal plate 176 and the other interrelated mechanical parts previously described.

As the toy is operating, contact 106′ continually shifts back and forth between contacts 108′ and 110′ as the operator shifts the object 28 from over the surface of the left side belt 80 to the surface of the right side belt 84 by use of steering wheel 32. Further as both the left side belt 80 and the right side belt 84 rotate about the respective front and back spindles 86 and 88 contacts 116′ and 118′ continually open and close as the obstacles 30 and their corresponding cutouts 112 allow contact between spring contact 116 and 118 with transverse contact 114.

If the operator makes a mistake and allows the object 28 to assume an interference position with an obstacle 30 either contact 106′ will close simultaneously with 108′ when contact 116′ closes with 114′ or contact 106′ will close simultaneously with 110′ when contact 118′ closes with contact 114′. In either case the electrical circuit through the object obstacle interference detection switches 456 will be closed and solenoid 180′ will be energized. Flasher switch 444 which is alternately opening and closing in response to the rotation of cam 56 alternately opens and closes a circuit between switch 456, lamp 442 and battery pack 46'. This causes lamp 442 to flash on and off. Solenoid 180' via linkage 460 causes disc 434' to rotate until contact 438' is no longer insulated by cutout portion 440' and a circuit is completed through contact 438', disc 434' and contact 436'. Disc 160 continues rotating until it is stopped by lower ratchet teeth 168 which holds pinion 164 against clicker extension 88. This causes the toy to emit a noise which in conjunction with the flashing of lamp 442 indicates to the operator of the toy 20 that he has "crashed".

Assuming that a crash occured because of contact between contact 106' with contact 108' and contact 116' with contact 114', once this crash occurs and drive diverter 458 is activated, the operator cannot cancel the crash by simply breaking contact between contact 106' with contact 108' by moving the object 28 to the other belt. Because the circuit through solenoid 180' is now completed through the alternate circuit through diverter switch 458 the position of contact 106 with 108 or 110 no longer governs the operation of solenoid 180', lamp 442 and pinion 164. The only way the operator can restore normal operation is by depressing the start-reset button 36' therein breaking the second circuit and as previously noted this automatically deactivates the lap counter 42 for an increment of time penalizing the operator for the crash.

I claim:

1. A toy game of skill which comprises:

a base;

an orbiting support member, said orbiting support member having a substantially continuous surface, support member mounting means attached to said base, said orbiting support member attaching to said support member mounting means;

driving means mounted on said base, said drive means connecting to and orbiting said orbiting support member in a path around said support member mounting means such that said substantially continuous surface of said orbiting support member orbits around said mounting means;

said orbiting support member including at least one obstacle means on said surface of said support member, said obstacle means repeatedly orbiting about said orbiting support means;

an object member slidably mounted on said base proximal to said surface of said orbiting support member and including an object member moving means for moving said object member in respect to said surface of said orbiting support member;

said object member moving in respect to said surface of said support member and including an interference position between said object member and said obstacle means;

detecting means for detecting when said object member is in said interference position with said obstacle means, said detecting means including an opening located in said surface of said support member and a sensor means located in association with said surface of said support member and capable of interacting with said opening when said object member is in said interference position with said obstacle means, said sensor means independent from said object member;

said detecting means including a drive disengagement means capable of disengaging said drive means from orbiting said orbiting support member when said object means is in said interference position.

2. The toy of claim 1 including:

indicating means indicating when said detecting means detects that said object member is in said interference position with said obstacle means.

3. The toy of claim 2 including:

reset means for restarting said drive means orbiting said orbiting support member.

4. The toy of claim 3 including:

counter means for counting the orbits of said orbiting support member.

* * * * *

UNITED STATES PATENT AND TRADEMARK OFFICE

CERTIFICATE OF CORRECTION

PATENT NO. : 4,352,493

DATED : October 5, 1982

INVENTOR(S) : Hiroyuki Watanabe

It is certified that error appears in the above-identified patent and that said Letters Patent is hereby corrected as shown below:

Column 7, line 52, "will" should read --will be--.

Column 12, line 58, "tens wheel 382" should read --tens wheel 362--.

Column 13, line 23, "support member 358" should read --support member 338--.

Column 13, line 44, "support member 358" should read --support member 338--.

Column 13, line 58, "cutout portion 348" should read --cutout portion 358--.

Column 14, line 55, "effected" should read --affected--.

Column 14, line 66, "button 35" should read --button 36--.

Signed and Sealed this

*Thirty-first* Day of *May 1983*

[SEAL]

*Attest:*

DONALD J. QUIGG

*Attesting Officer*

*Acting Commissioner of Patents and Trademarks*